US006234370B1

(12) United States Patent
Kummerle et al.

(10) Patent No.: US 6,234,370 B1
(45) Date of Patent: May 22, 2001

(54) FOOT COVERING ASSISTANCE DEVICE

(75) Inventors: Werner Kummerle, Cincinnati, OH (US); Kevin K. Kummerle, 6890 Marblehead Dr., Cincinnati, OH (US) 45243

(73) Assignee: Kevin K. Kummerle, Cincinnati, OH (US)

( * ) Notice: Subject to any disclaimer, the term of this patent is extended or adjusted under 35 U.S.C. 154(b) by 0 days.

(21) Appl. No.: 09/602,907

(22) Filed: Jun. 23, 2000

(51) Int. Cl.[7] ..... A47G 25/90
(52) U.S. Cl. ..... 223/112; 223/111
(58) Field of Search ..... 223/111, 112, 223/120; 36/11.5

(56) References Cited

U.S. PATENT DOCUMENTS

| | | | | |
|---|---|---|---|---|
| D. 294,076 | * | 2/1988 | Birritela | D2/293 |
| 1,681,548 | * | 8/1928 | Marcus | 36/11.5 |
| 2,828,057 | * | 3/1958 | MacLauchlan | 223/111 |
| 3,310,209 | | 3/1967 | Clauss | 223/111 |
| 3,452,907 | | 7/1969 | MacLauchlan | 223/111 |
| 3,993,228 | * | 11/1976 | Fuhr | 223/111 |
| 4,260,083 | * | 4/1981 | Aslin | 223/111 |
| 4,637,533 | | 1/1987 | Black | 223/112 |
| 4,651,909 | | 3/1987 | Banting | 223/111 |
| 4,858,795 | | 8/1989 | Selinko | 223/111 |
| 4,943,097 | | 7/1990 | Sanger | 294/19.1 |
| 4,991,757 | | 2/1991 | Deakyne | 223/112 |
| 5,636,774 | * | 6/1997 | Moscato | 223/112 |
| 5,799,844 | * | 9/1998 | James | 223/112 |
| 5,826,761 | | 10/1998 | Basaj | 223/112 |
| 5,909,831 | * | 6/1999 | Griffin | 223/112 |
| 5,946,737 | * | 9/1999 | Fleege | 2/455 |
| 6,056,171 | * | 5/2000 | Santamaria | 223/112 |

* cited by examiner

*Primary Examiner*—Bibhu Mohanty
(74) *Attorney, Agent, or Firm*—Wood, Herron & Evans, L.L.P.

(57) ABSTRACT

Individuals who have difficulties in donning a foot covering such as a sock or stocking are provided with the assistance of a sock starter having a base and two opposing members extending over a toe end of the base. The opposing members are pivotally coupled laterally to the base to form a cavity corresponding to the outline of the forward portion of a foot. A user draws an opening of the foot covering over the opposing members and under a laterally and forwardly open relieved area of the toe end of the base. The user then places the sock starter upon the floor. Then the forward portion of the foot is inserted into the cavity, and longitudinally extended to capture the foot covering onto the forward portion of the foot and withdrawing the foot covering from the sock starter. The exposed opposing members then open when contacted by the foot allowing the foot to be removed from the base.

9 Claims, 3 Drawing Sheets

FOOT COVERING ASSISTANCE DEVICE

FIELD OF THE INVENTION

The present invention relates to devices used to don foot coverings such as socks or support hose, and, more particularly, to those devices that enable a person who is not otherwise able to put on foot coverings by themselves to don their socks without the assistance of another person.

BACKGROUND OF THE INVENTION

People with various physical conditions have difficulty in dressing themselves, creating obstacles to independent living. Donning a foot covering such as a sock or stocking is frequently difficult due to the various combinations of leg and arm limitations that affect this activity. Examples of limiting physical conditions include diminished range of motion in the back or knee, or leg strength, such that the foot cannot easily be brought into reach. Another example is limited hand strength or limited range of motion in the fingers of both hands. Such conditions make it difficult or impossible to widen the opening of the foot covering while simultaneously inserting the toes and ball of one foot into the opening. The difficulty may be pronounced for foot coverings such as a support stocking intended to fit snugly on the foot.

Generally known devices for assisting in the donning of a foot covering have a sock spreader that includes a concave portion for holding the foot covering open so that the foot may be inserted. Then, the concave portion is withdrawn along the heel or calf. An extension, strap or pole typically projects rearward from the sock spreader for withdrawing the sock spreader from the foot or leg. The known techniques of withdrawing the concave portion rearward require a significant amount of hand strength to pull on the rearward extension, strap or pole. Consequently, such devices are typically only suited to users with sufficient strength.

In addition, the concave portion of some known sock spreaders is necessarily a shape that also excludes users with limited hand strength or without the use of two hands. Starting the sock onto the sock spreader is easier when the concave portion is funnel-shaped with a smaller, forward end. However, withdrawing the concave portion by the heel and ankle means that this forward end has to be relatively wide. Consequently, two hands are needed to open the sock wide enough to be started onto the sock spreader. Therefore, those without full use of two hands have difficulty using known sock spreaders. This difficulty is especially pronounced for support hose that are intended to have a snug fit. Consequently, another person may then be required to pre-load a foot covering onto the sock spreader for later use by the user.

In other known sock starters, the concave portion that receives a sock is configured to flex so that the opening of the sock will draw upper edges of the concave portion inward. A problem with these flexible concave portions is that a foot covering that is to be worn with a snug fit tends to collapse such concave portions. Overcoming this deficiency so that a foot may be inserted means making the concave portion more rigid, and thus more difficult for the user to install a foot covering.

A further problem with generally known sock starters is that the user must hold the foot and sock starter off of the floor. Otherwise, the foot covering that is inserted over the sock starter will be pressed between the sock starter and the floor, requiring additional force to be exerted to overcome this friction. This limitation means that generally known sock starters are not appropriate for dressing from a standing position. Also, the sock starter necessarily must be light in order to be lifted by the leg. It is thus necessary to provide a way to pull the foot covering onto the foot since the sock starter moves with the foot.

Consequently, a significant need exists for an improved device for donning a foot covering.

SUMMARY OF THE INVENTION

The present invention provides a sock starter and method for using a sock starter for assisting in donning foot coverings such as socks and stockings. The sock starter includes a base that supports the foot. Two opening members, such as arcuate plates, cooperate with the base to expansively form a cavity corresponding to an outline of a forward portion of the foot. The two opposing members open when the foot covering is withdrawn forward by the insertion of the foot into the cavity, allowing the foot to be removed from the sock starter.

In one aspect consistent with the invention, the base includes a laterally and forwardly open relieved area substantially underlying the two opposing members. The relieved area prevents the foot covering from being pressed between the sock starter and the floor. Thus, a sock starter of sufficient mass and friction may be used so that the forward movement of the foot alone is sufficient to capture the foot covering without an additional pulling arrangement. Moreover, the forward movement of the foot alone is also sufficient to withdraw the foot covering from the sock starter, allowing the opposing members to open as the foot is removed from the base.

These and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
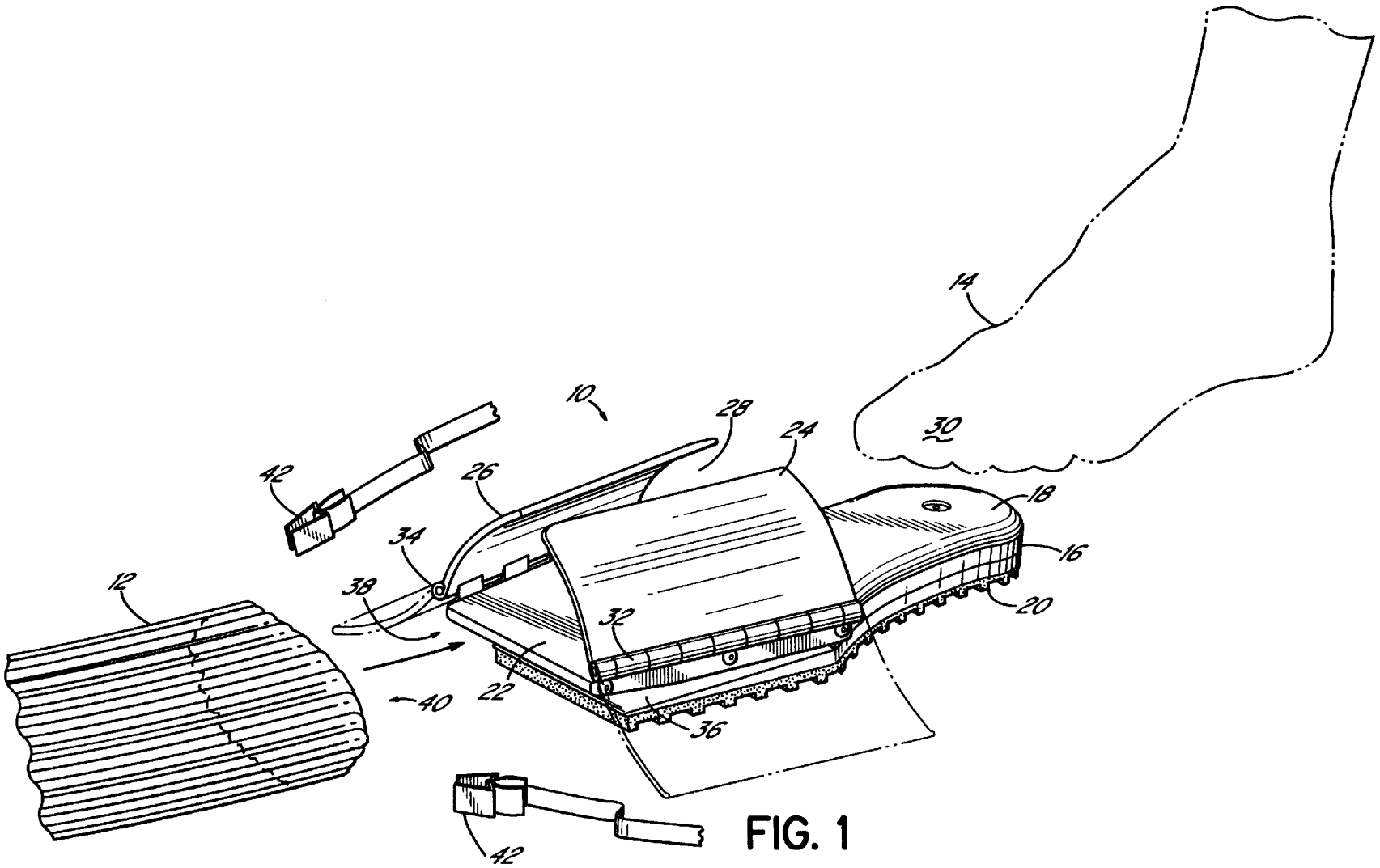
FIG. 1 is a perspective view consistent with the invention of a sock starter prior to installing a foot covering, illustrating two arcuate plates of the sock starter selectively closing to form a tubular arrangement to receive a foot covering and a foot.

Turning to the figures, wherein like numbers denote like parts throughout the several views, FIG. 1 illustrates a sock starter 10 consistent with aspects of the invention. A foot covering 12 is depicted prior to being installed on the sock starter 10 and prior to being donned on a foot 14. The sock starter 10 is depicted including a base 16 having a top surface 18 for supporting the foot 14, and a bottom surface 20 for contacting a load-bearing surface or floor.

At the forward, toe end 22 of the base 16, A left arcuate plate 24 and a right arcuate plate 26 are pivotally mounted on respective lateral sides, forming a pair of opposing members. In particular, a left hinge 32 and right hinge 34, aligned with one another, respectively couple the left and right arcuate plates 24, 26 to the base 16. The hinges 32, 34 allows the plates 24, 26 to inwardly move to a closed position forming a cavity 28 with the base 16 corresponding to the upper outline of a forward portion 30 of the foot 14. The hinges 32, 34 further allow the plates 24, 26 to outwardly move to an open position, as shown in phantom in FIG. 1, exposing the toe end 22 of the base 16.

The base 16 includes a laterally and forwardly open slot 36 10 between the top and bottom surfaces 18, 20. The slot 36 substantially underlies the arcuate plates 24, 26. The slot 36 provides a relieved area 38 for receiving a lower portion of an opening 40 of the foot covering 12 so that the foot covering 12 will not pressed against a load-bearing surface.

Figure 2:
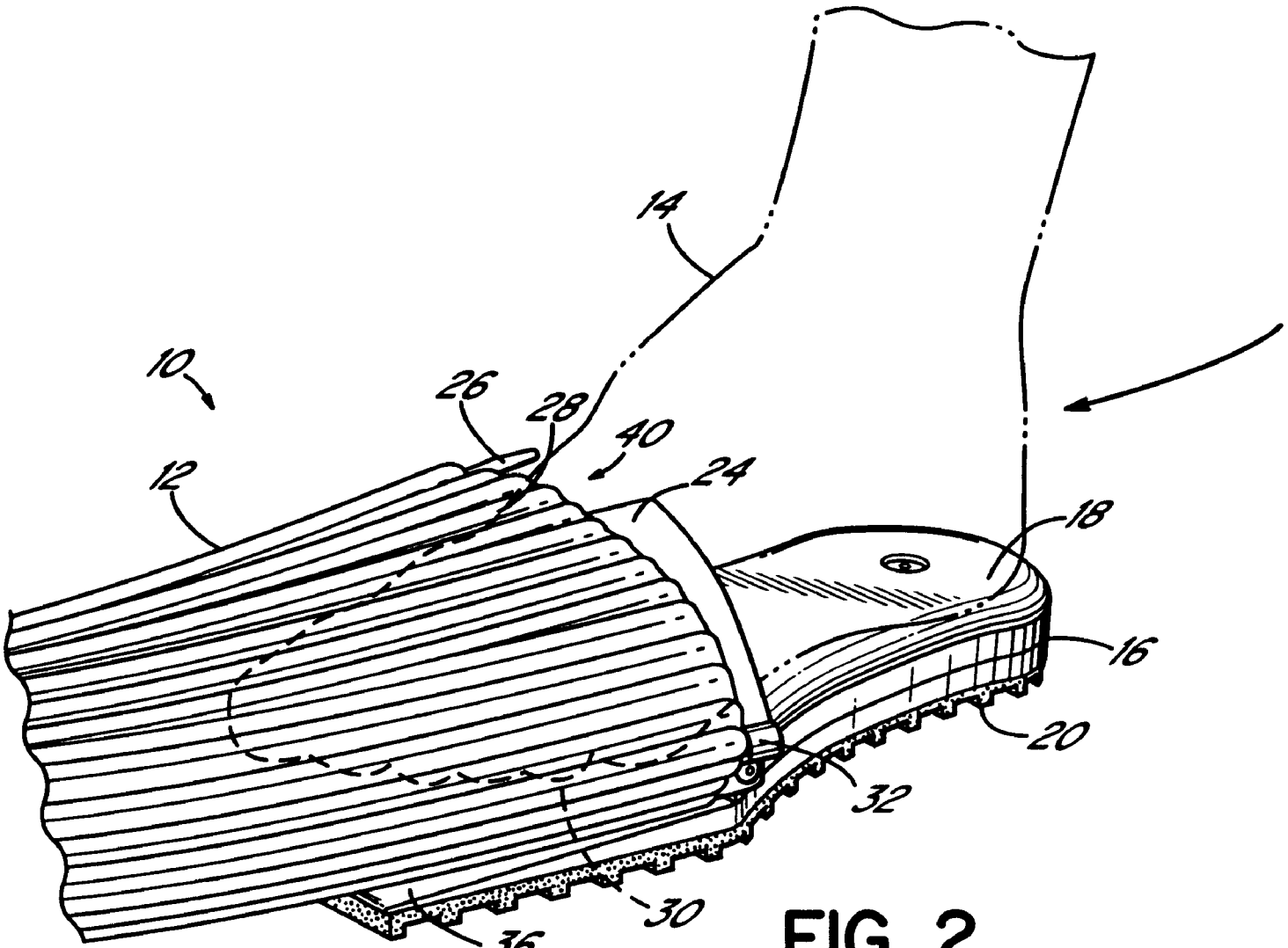
FIG. 2 is a perspective view of the sock starter of FIG. 1 with the closed arcuate plates closed substantially encompassing a forward portion of the foot in preparation for donning the foot covering received around the tubular arrangement.
Figure 3:
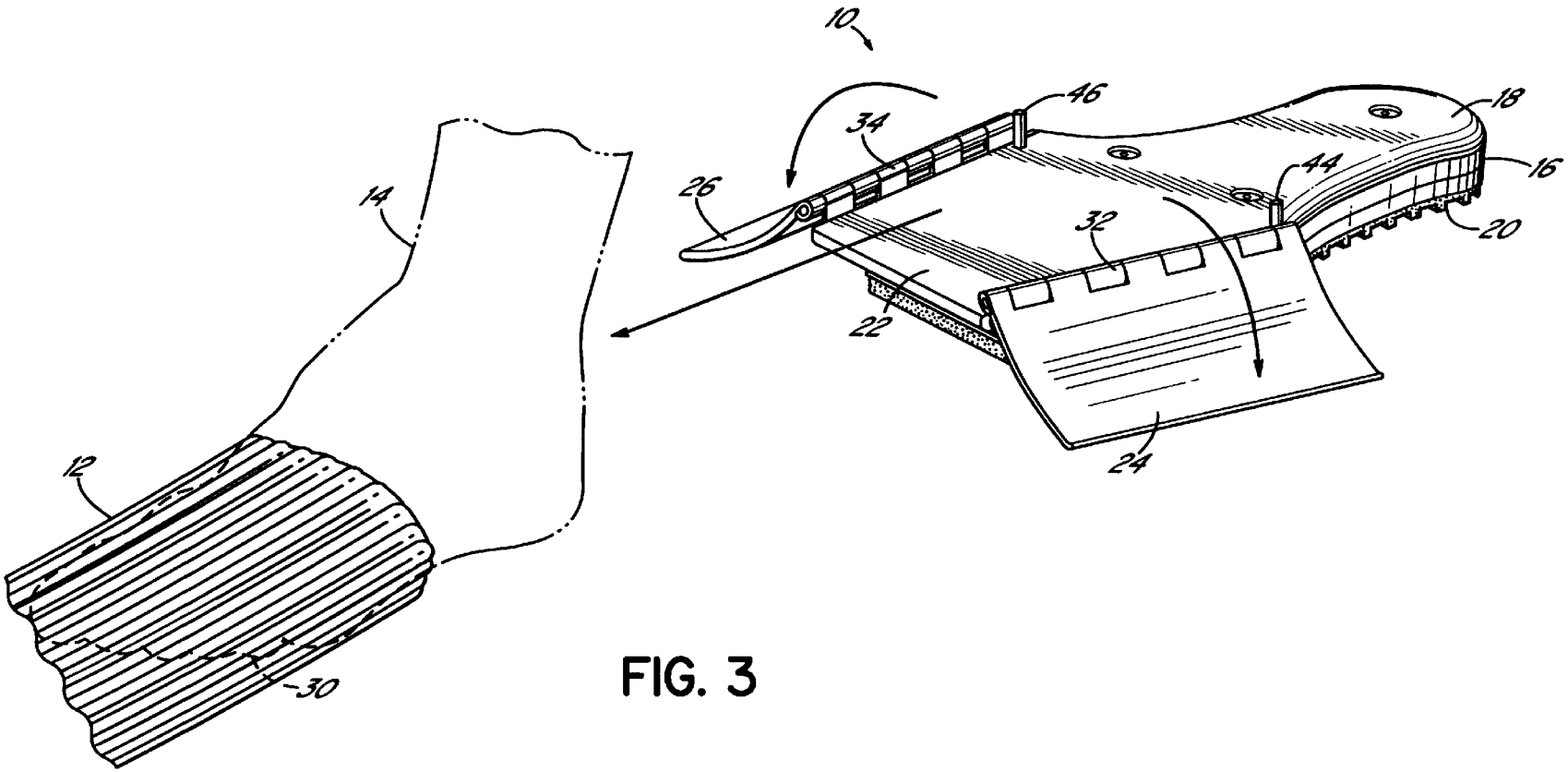
FIG. 3 is a perspective view of the sock starter of FIG. 2 after the foot has forwardly extended capturing the sock and exposing the arcuate plates for opening.

It will be appreciated by those having skill in the art and the benefit of the instant disclosure that the sock starter 10 described herein may be used for various types of foot coverings 12, such as socks, stockings, and support hose. The depiction of a sock as the foot covering 12 in FIGS. 1–3 is for illustration only and will be appreciated as not a suggested limitation of the sock starter 10. Since some applications consistent with the invention prevent inward travel of the arcuate plates 24, 26 beyond the closed position, as discussed below with regard to FIG. 3. Consequently, foot coverings 12 are prevented from collapsing the cavity 28, even with the use of a snug fitting foot covering 12 such as support hose.

Also, the smooth contours depicted for arcuate plates 24, 26 advantageously allow the foot covering 12 to be installed onto the sock starter 10. However, some applications consistent with aspects of the invention may include additional resisting features for resistingly holding the foot covering on the sock starter 10 during insertion of the foot 14. For example, raised ridges, a burled surface, or clips may be included on the arcuate plates 24, 26. In addition, rather than solid arcuate plates 24, 26, various pivotal structures such as wire frames may be used. Also, the relieved area 38 may be shaped and/or angled to resist withdrawing the foot covering 12. The additional resisting features may advantageously be used with loose fitting foot coverings 12.

Alternatively, the sock starter 10 may be used with a pair or separate gripping members 42 that grip the opening 40 of the foot cover 12. For example a pair of straps terminating in clips for pinching the opening 40 on opposing sides of a sock may used. Such separate gripping members 42 may be appropriate for applications in which the user has the use of at least one hand but poor range of movement in the knee. Thus, extensions of the gripping members 42 may be held after placing the sock starter 10 on the floor.

Referring to FIG. 2, the sock starter 10 of FIG.1 is depicted being used to start the foot covering 12 onto the foot 14. In particular, the arcuate plates 24, 26 are closed to receive and resistingly hold an opening 40 of the foot covering 12. The forward portion 30 of the foot is inserted into the cavity 28 to the point of initially contacting a portion of the foot covering 12 forward of the sock starter 10.

Referring to FIG. 3, the sock starter 10 is depicted with the foot 14 extending forward, capturing the foot covering 12. The foot movement also withdraws the foot covering 12 from the arcuate plates 24, 26, allowing each arcuate plate 24, 26 to outwardly move to the open position in response to being contacted by the foot 14. Consequently, the pivoting arcuate plates 24, 26 may provide a cavity 28 that is appropriately sized for the foot 14 yet readily allow removal of the foot 14 once the foot covering 12 is started. Thus, the foot covering 12 may be received on the sock starter 10 without excessive stretching avoiding damage to the foot covering 12, as well as reducing the amount of hand strength for installing the foot covering 12 onto the sock starter 10.

The sock starter 10 may include additional cavity adjustment features for adjusting the size of the cavity 28 to further control the amount of required stretching of the opening 40. For example, a left hinge stop 44 and a right hinge stop 46 used to define the closed position of the arcuate plates 24, 26 may be adjustable, allowing the vertical dimension of the cavity 40 to be controlled. Additionally, the lateral spacing of the coupling of the arcuate plates 24, 26 may be adjustable, as would be known to those skilled in the art having benefit of the instant disclosure.

The bottom surface 20 of the base 16 may advantageously provide frictional contact with the floor to resist sliding so that a user may safely stand upon the sock starter 10. In addition, the frictional bottom surface 20, in combination with an appropriately weighted sock starter 10, may allow the foot covering 12 to be captured by the foot 14 with only the force of the foot movement. In particular, the plates 24, 26 and relieved area 38 resistingly holds the opening 40 of the foot covering 12 in place as the foot 14 is inserted. Alternatively, a sock starter 10 may be attachable to a supporting surface or manually held while inserting the foot 14.

In use, the opening 40 of the foot covering 12 is pulled rearward over the closed arcuate plates 32, 34 and within the slot 36 of the sock starter 10. The sock starter 10 is then placed on the floor. The forward portion 30 of the foot 12 is inserted into the cavity 28 formed by the arcuate plates 32, 34 and toe end 22 of the base 16. The cavity is forwardly open, allowing the foot 14 to contact the portion of the foot covering 12 that is in front of the sock starter 10. As the foot 14 continues forward, the foot covering 12 is captured by foot 14, pulling the foot covering 12 forward and exposing the arcuate plates 32, 34. Since no longer held closed by the opening 40 of the foot covering 12, the arcuate plates 32, 34 readily outwardly open when contacted by the foot 14 during removal from the sock starter 10.

In the event that a separate gripping member 42 is useful to the user, the user would attach the separate gripping member 42 to the opening 40 of the foot covering 12 at the time of installing the foot covering onto the sock starter 10. When lowering the sock starter 10 to the floor, the user maintains control of the separate gripping member 42, such as by holding an unattached extension of the gripping member 42. After using the sock starter 10 to capture the foot covering 12 and removing the foot 14 from the sock starter 10, the user may then pull on the separate gripping member 42 to complete donning the foot covering 12. At which time, the gripping member 42 may be removed with an additional pulling force or by now being accessible to the user's hand.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A device comprising:

a base having a lower face configured for contacting a load-bearing surface and an upper face for supporting a foot, the base further having a laterally and forwardly open relieved area beneath the upper face; and a pair of rigid opposing members pivotally coupled to the base and extending over the upper surface of the base for selectively outwardly opening and inwardly closing to form an expansible opening corresponding to an outline of a forward portion of the foot, the base and the pair of rigid opposing members cooperatively configured to receive and hold open an aperture of a foot covering.

2. The device of claim 1, wherein the relieved comprises a forwardly and laterally open slot for cooperating with the pair of rigid opposing members in receiving and holding open the aperture of the foot covering.

3. The device of claim 1, wherein the pair of rigid opposing members comprises a pair of arcuate plates.

4. The device of claim 1, further comprising a pair of hinges, wherein each of the pair of rigid opposing members is pivotally coupled to the base with one of the hinges, the pair of hinges adapted to limit inward closing of the rigid opposing members.

5. The device of claim 1, wherein the lower face of the base further includes a frictional surface, the device configured to have sufficient weight to resist lateral movement by frictionally engaging the frictional surface to an underlying load bearing surface.

6. The device of claim 1, further including a gripping member configured to couple to the aperture of the foot covering, the gripping member including an extension for a user to grasp.

7. The device of claim 1, further comprising a pair of opening adjustment members respectively coupled to the each of the rigid opposing members and the base and configured for adjusting a minimum size of the opening of the device.

8. A method of donning a foot covering, the method comprising: providing a device having frictional inertia to remain stationary on a load bearing surface, the device including two rigid opposing members at a toe end of a base of the device, each member pivotally coupled laterally on the base, forming an opening corresponding to an outline of a forward portion of the foot—after opening, the device having a forwardly open relieved area of the base, inwardly closing the two rigid opposing members;

installing an aperture of the foot covering circumferentially over a combination of the opposing members and the laterally and forwardly open relieved area of the base;

inserting a forward portion of a foot into the opening;

longitudinally extending the foot further into the foot covering, capturing the foot covering onto the forward portion of the foot and withdrawing the foot covering from the device; and removing the foot from the base, causing an outward opening of the rigid opposing members.

9. The method of claim 8, further comprising:

attaching a gripping member to the aperture of the foot covering; and pulling on the gripping member to complete donning the foot covering in response to removing the foot from the base.

* * * * *